US009326067B2

(12) United States Patent
Usher et al.

(10) Patent No.: US 9,326,067 B2
(45) Date of Patent: Apr. 26, 2016

(54) MULTIPLEXING AUDIO SYSTEM AND METHOD

(71) Applicant: Personics Holdings, LLC, Boca Raton, FL (US)

(72) Inventors: John Usher, Beer (GB); Steven W. Goldstein, Delray Beach, FL (US)

(73) Assignee: Personics Holdings, LLC, Boca Raton, FL (US)

( * ) Notice: Subject to any disclaimer, the term of this patent is extended or adjusted under 35 U.S.C. 154(b) by 164 days.

(21) Appl. No.: 14/259,829

(22) Filed: Apr. 23, 2014

(65) Prior Publication Data

US 2014/0314238 A1 Oct. 23, 2014

Related U.S. Application Data

(60) Provisional application No. 61/814,878, filed on Apr. 23, 2013, provisional application No. 61/894,970, filed on Oct. 24, 2013, provisional application No. 61/920,321, filed on Dec. 23, 2013.

(51) Int. Cl.

| | |
|---|---|
| ***H04R 5/033*** | (2006.01) |
| ***H04R 3/04*** | (2006.01) |
| ***H04S 5/02*** | (2006.01) |
| ***H04S 3/00*** | (2006.01) |
| ***G10L 19/008*** | (2013.01) |
| *H04R 1/10* | (2006.01) |
| *H04R 3/00* | (2006.01) |

(52) U.S. Cl.

CPC ..... *H04R 3/04* (2013.01); *G10L 19/008* (2013.01); *H04R 1/1016* (2013.01); *H04R 1/1041* (2013.01); *H04R 3/005* (2013.01)

(58) Field of Classification Search

CPC ..... H04R 3/005; H04R 2201/107; H04R 2410/05; H04R 25/353; H04R 5/033

USPC ..... 381/74, 312, 315, 98, 17–19

See application file for complete search history.

(56) References Cited

U.S. PATENT DOCUMENTS

| | | | | |
|---|---|---|---|---|
| 2007/0237342 | A1* | 10/2007 | Agranat | H04R 1/406 381/97 |
| 2008/0031475 | A1* | 2/2008 | Goldstein | H04M 1/05 381/151 |
| 2010/0158269 | A1* | 6/2010 | Zhang | G10L 21/0208 381/94.2 |
| 2010/0246831 | A1* | 9/2010 | Mahabub | G10L 19/018 381/17 |
| 2012/0121220 | A1* | 5/2012 | Krummrich | H04B 10/2581 385/28 |
| 2012/0321097 | A1 | 12/2012 | Braho | |
| 2013/0039512 | A1* | 2/2013 | Miyata | H04R 3/12 381/97 |

* cited by examiner

*Primary Examiner* — Duc Nguyen
*Assistant Examiner* — George Monikang
(74) *Attorney, Agent, or Firm* — Pablo Meles

(57) ABSTRACT

A method and system for multiplexing audio signals into a single channel uses frequency division multiplexing. The frequency division multiplexing method herein is based on a frequency transform algorithm using FFT shifting that does not require a carrier signal for the modulation. In one embodiment, two input microphone audio signals are frequency shifted and the resulting single audio channel is directed over a standard input connection to a computing device, for instance, a smart phone using a wired TRRS connection. The TRRS analog input of the computing devices exhibits a high-pass characteristic, and the frequency shifting method enables the low frequency audio components of input audio signals to be received and processed by a software application on the smart phone. Other embodiments are disclosed.

19 Claims, 15 Drawing Sheets

100

135

140

150

160

200

410

420

430

440

450

500

600

700

800

MULTIPLEXING AUDIO SYSTEM AND METHOD

CROSS-REFERENCE

This application is a utility patent application that claims the priority benefit of U.S. Provisional Patent Application No. 61/814,878 filed on Apr. 23, 2013, 61/894,970 filed on Oct. 24, 2013, and 61/920,321 filed on Dec. 23, 2013, the entire disclosures and content of which are incorporated herein by reference in their entireties.

FIELD

The present invention relates to processing audio signals, and particularly to methods and devices for multiplexing audio signals and mobile audio devices using either a standard type analog audio connection or a wireless audio communication means for receiving multiplexed audio signals.

BACKGROUND

Sound isolating (SI) earphones and headsets are becoming increasingly popular for music listening and voice communication. SI earphones enable the user to hear an incoming audio content signal (whether speech or music audio) clearly in loud ambient noise environments, by attenuating the level of ambient sound in the user ear-canal.

To maximize situation awareness and enable an SI earphone user to hear their local ambient environment, SI earphones often incorporate ambient sound microphones to pass through local ambient sound to the loudspeaker in the SI earphone. Sound isolating earphones can also incorporate an ear canal microphone for detecting the earphone user voice with an improved signal to noise ratio over using an external ambient sound microphone to detect the voice. The ear canal microphone signal can be further processed with noise reduction algorithms and directed to a mobile device for voice communication purposes, e.g. for voice activated machine control or in a telephone call with a remote individual.

Recording and processing of the ambient sound microphone signals and ear canal microphone signals can provide benefits for the user: for archival of ambient sound recordings (e.g. binaural recordings) or for further processing e.g. for noise reduction. However, the analog audio input to most mobile phones and other mobile computing devices often only allow for a single, "mono" audio channel to be received. A need therefore exists to enable the mobile computing device to receive more than one audio input channel from an earphone or pair of earphones that contain multiple microphone signals.

DETAILED DESCRIPTION

Figure 1A:
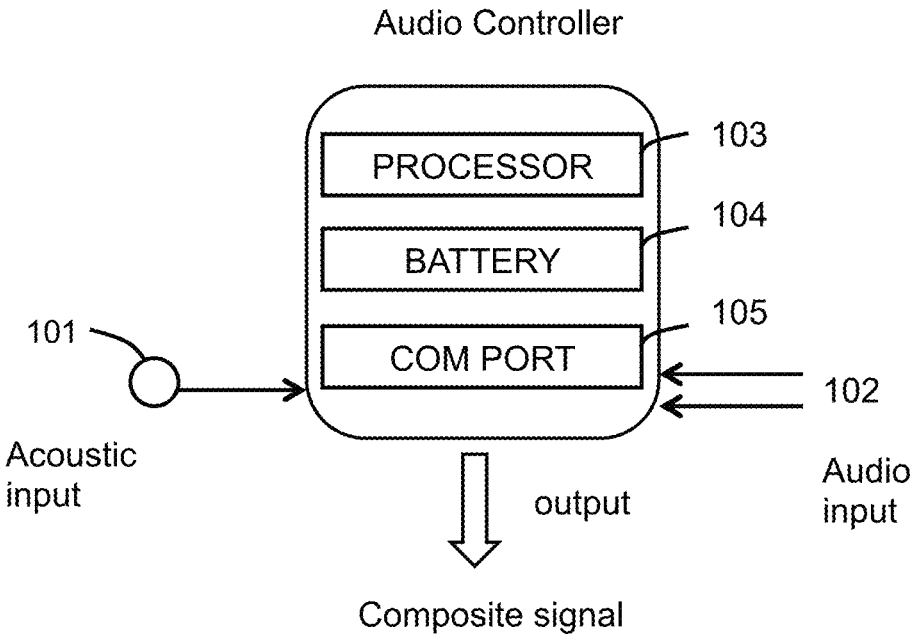
FIG. 1A illustrates an audio controller in accordance with an exemplary embodiment.

The following description of at least one exemplary embodiment is merely illustrative in nature and is in no way intended to limit the invention, its application, or uses. Similar reference numerals and letters refer to similar items in the following figures, and thus once an item is defined in one figure, it may not be discussed for following figures.

Herein provided is a method and system for multiplexing two or more audio signals to produce a composite audio signal and directing the composite audio signal to a receiving device with a single audio input; mono or stereo. The standard TRRS audio jack is one such single audio input that has and remains common, primarily because it is the accepted standard for audio input; namely, headphones and earpieces for listening purposes. The receiving device can thereafter demultiplex the composite audio signal from the single audio input into the two or more audio signals in original form and process accordingly. The multiplexing/demultiplexing can be performed on a standalone module external to the receiving device, or one that can be integrated or embedded in an accessory or wearable device, prior to delivery to the receiving device.

The method and system for multiplexing audio signals into a single channel includes a frequency division multiplexing scheme based on a frequency transform algorithm using a Fast Fourier Transform (FFT) shifting. One novel aspect of this scheme is that it does not require a carrier signal for the modulation. In one embodiment, two input microphone audio signals are frequency shifted and the resulting single audio channel is directed over a standard input connection to a computing device, for instance, a smart phone using a wired Tip, Ring, Ring, Sleeve (TRRS) connection. The TRRS analog input of the computing devices exhibits a high-pass characteristic, and the frequency shifting method enables the low frequency audio components of input audio signals to be received and processed by a software application on the smart phone.

In another configuration, the multiplexing and de-multiplexing audio system herein described is used in conjunction with a spectral expansion system. The spectral expansion system synthetically extends the audio bandwidth of each reconstructed audio signal; this can enhance the perceived quality of the audio and improve the listening experience and intelligibility of speech. More specifically, the spectral expansion increases the bandwidth of each de-multiplexed signal. As will be explained ahead in further detail, the spectral expansion operates on the premise of a mapping transformation to predict high frequency content from low frequency content. In one embodiment, the mapping is based on a training analysis (learning) of a reference wide band signal envelope and a reference narrowband signal envelope following the multiplexing process. In another embodiment the mapping is determined prior to the multiplexing process without training (learning).

FIG. 1A depicts an audio controller 100 to multiplex multiple audio input signals and produce a composite signal. The audio controller 100 includes at least one microphone 101, one or more audio input paths 102, and a processor 103 for receiving audio signals from the microphone 101 and input paths 102. A battery 104 provides power to the electronic circuitry, including the processor 103, for enabling operation. As will be explained ahead, these input audio paths can be provided from other devices over a wired or wireless communication path via the com port 105. These components can be integrated and/or incorporated into wearable devices as will be shown ahead.

The audio controller 100 is illustrated as a standalone device to perform the multiplexing between two multimedia devices, for example, a mobile phone and a wearable device or wearable, as will be described ahead. The wearable can be eyeglasses and/or an earpiece, or combination thereof, each with multiple microphones or sensors. The mobile device can be the receiving device with a single audio input (e.g., headphone jack); for example, a smart phone or smart wristwatch. The audio controller 100, upon receiving the audio signals 101/102 (e.g., microphone, speakers) from the wearable, multiplexes them together into the composite signal which is then be directed to the standard audio input of the receiving device. One example of an audio input connector is the Tip, Ring, Ring, Sleeve (TRRS) input connector having distinct contacts capable of conducting analog signals. The audio controller 100 can perform the multiplexing in analog and/or digital format. Mobile devices generally have only one audio input connector, so the multiplexing provides audio input expansion for supporting multiple audio input processing and audio data collection.

The audio controller 100 can be configured to be part of any suitable media or computing device. For example, the system may be housed in the computing device or may be coupled to the computing device. The computing device may include, without being limited to wearable and/or body-borne (also referred to herein as bearable) computing devices. Examples of wearable/body-borne computing devices include head-mounted displays, earpieces, smart watches, smartphones, cochlear implants and artificial eyes. Briefly, wearable computing devices relate to devices that may be worn on the body. Bearable computing devices relate to devices that may be worn on the body or in the body, such as implantable devices. Bearable computing devices may be configured to be temporarily or permanently installed in the body. Wearable devices may be worn, for example, on or in clothing, watches, glasses, shoes, as well as any other suitable accessory.

In another arrangement the audio controller 100 can also be coupled to, or integrated with, non-wearable devices. For example, audio controller 100 can also be coupled to other devices, for example, a series of security cameras, to multiplex collected audio signals from each camera to reduce audio data bandwidth; that is, compress the separate audio signals for sending over a fewer number of audio channels. For example, whereas a security system may have multiple audio inputs, but only access to only a single audio stream for delivery, the audio controller 100 can reduce the audio channel requirements for interface to a single audio receiving device.

Figure 1B:
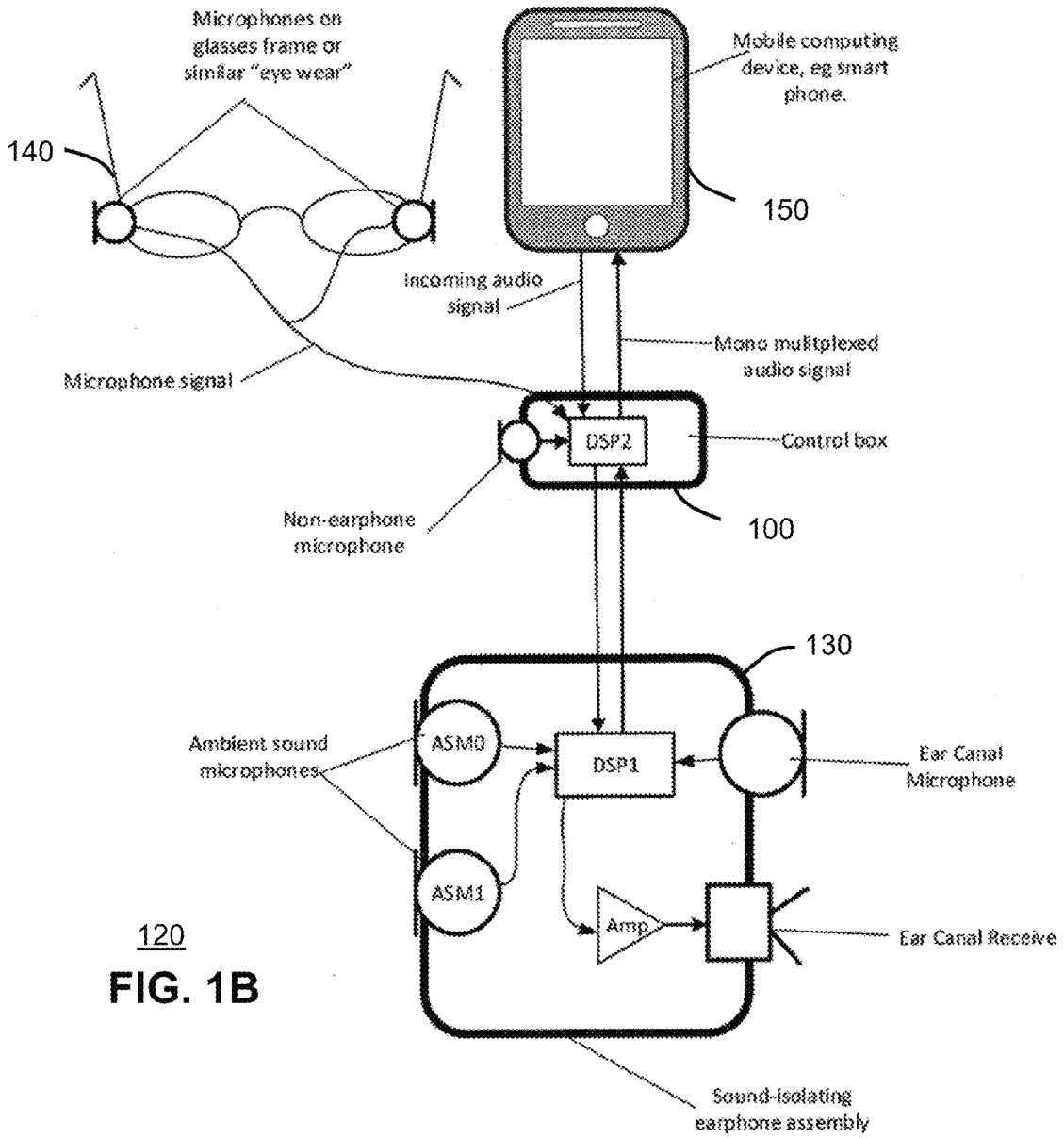
FIG. 1B depicts a hardware configuration for a multiplexing audio system in accordance with an exemplary embodiment.

Referring to FIG. 1B, a communication system 120 for multiplexing audio signals in accordance with a voice communication embodiment is shown. The system 120 in this embodiment includes the audio controller 100, earphone 130, eyeglasses 140 and a mobile device 150. Notably, more or less than the number of components shown may be connected together at any time. For instance, the eyeglasses 140 and earpiece 130 can be used individually or in conjunction. The system 120 communicatively couples the audio controller 100 with the mobile device 150 (voice communication/control; e.g. mobile telephone, radio, computer device) and/or at least one audio content delivery device (e.g. portable media player, computer device) and wearable devices (e.g., eyeglasses 140 and/or earphone 130). The eyeglasses 140 and earphone 130 are communicatively coupled to the audio controller 100 (herein after may be referred to as "audio control box") to provide audio signal connectivity via a wired or wireless communication link.

The earphone 130 includes one or more microphones and transducers (output speakers) as input or output audio signal paths as will be described ahead in further detail. Additional external microphones may be mounted on the eyeglasses 140, similar to a frame associated with a pair of glasses, e.g., prescription glasses or sunglasses, as shown in the figure. The audio controller 100 houses user interface buttons and displays (or a touch screen display), and can house additional microphones, which can be multiplexed with the earphone input signals. This extra microphone on the audio controller 100 provides spatial separation with the microphones on the wearables (e.g., eyeglasses 140/earpiece 130) and allows for manual directivity and provides for sound localization of lower level sounds, for example, those originating or residing near ground level (e.g., car noise, rumble, etc); low frequency sounds that resonate over surfaces.

As an example, the user can hold and orient the audio controller 100 in a direction of a sound source to train the system to learn the location of the sound source and its spectral characteristics with respect to the orientation of the wearable devices (the microphones on the eyeglass wearables are at an orientation aligned with the user's visual direction). It includes a digital signal processor (DSP) to receive audio content signals from the communication devices (e.g. mobile phone etc) or audio content delivery device (e.g. music player), and further receives/transmits audio signals from/to the wearable devices. The audio controller 100 is also operatively and communicatively coupled to the mobile device 150 via a wired or wireless communication link.

Figure 1C:
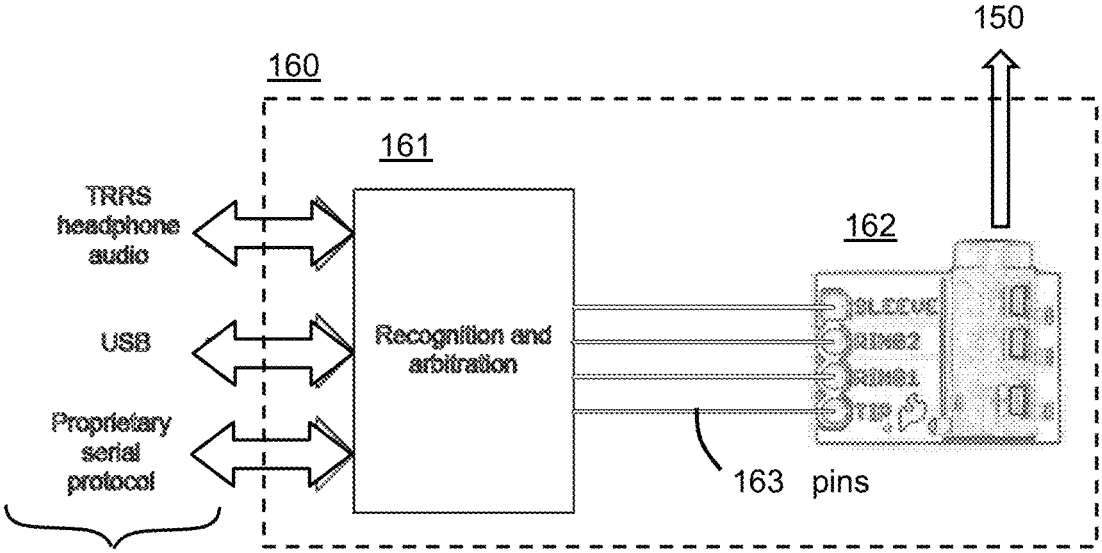
FIG. 1C illustrates an audio multiplexing switch for detecting and processing a composite signal comprising multiplexed audio signals in accordance with an exemplary embodiment.

Referring now to FIG. 1C, an intelligent switch 160 within the audio controller 100 (of FIG. 1A or 1B) is provided for multiplexing of the audio jack 162 on the mobile device 150. This intelligent switch can reside internal to a communication device (e.g., mobile device 150) to perform the de-multiplexing of the composite signal, or in other configurations integrated with the audio controller 100. The intelligent switch 160 comprises a processing unit 161 (which can be the same processor 103 when integrated together) and audio jack 162. The intelligent switch 160 by way of the audio jack 162 receives as input/output (I/O) the audio controller 100. The audio jack 162 can be, but not limited to, one of a headphone connector, earpiece connector, USB port, or proprietary serial protocol adapter. In the preferred embodiment the TRRS headphone audio is tied to the audio jack 162; that is, it may be under a same hardwired connection. In other configurations, these two inputs may be independent and separate.

The audio jack 162 can be a standard analog input jack, where the processing unit 161 provides a multiplex interface (adaptor) to other digital formats where required. For example, a digital headphone (or analog for that matter) can be inserted into the audio jack 162 and upon its detection by the processing unit 160 can receive digital audio data from other coupled multimedia inputs through the audio jack 162, for example, audio converted from a USB device communicatively coupled thereto or other proprietary serial interfaces. It also provides for bi-directional communication, for instance, to download microphone signals from the attached headset and store directly to the attached USB device by way of a conversion protocol. The bi-directional communication may be relay on separate pin 163 lines, or be interleaved in packet data format among multiple pins 163. Aspects of the intelligent switch 160 are disclosed in U.S. Provisional Patent Application 61/894,970, filed Oct. 24, 2013, entitled "Method and Device for Recognition and Arbitration of an Input Connection", the entire contents of which are hereby incorporated by reference.

Figure 1D:
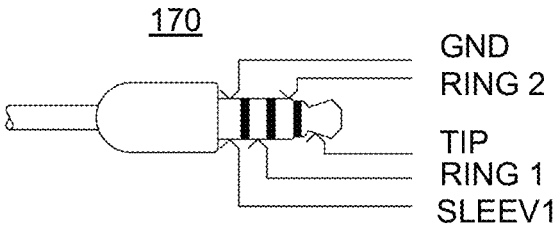
FIG. 1D illustrates an audio jack for receiving and delivering a composite audio signal comprising multiplexed audio signals in accordance with an exemplary embodiment.

FIG. 1D shows a corresponding input connector 170 for the input jack in accordance with one embodiment. In this embodiment, it is a physical plug comprising a Tip, Ring, Ring, Sleeve (TRRS) input connector, common for connector types used for analog signals, primarily audio. Various models supported herein are stereo plug, mini-stereo, microphone jack and headphone jack. A "mini" connector 170 has a diameter of 3.5 mm (approx. ⅛ inch) and the "sub-mini" connector has a diameter of 2.5 mm (approx. 3/32 inch). The processing unit 161 automatically detects a multiplexed signal on the input connector 170, for example a headset (or eyeglasses or wristwatch), whether digital or analog, and converts the multiplexed audio data, to, or from, other multimedia inputs or outputs of their respective audio input signals; that is, the audio signals originally summed (combined) together to produce the composite (multiplexed) audio signal.

Figure 1E:
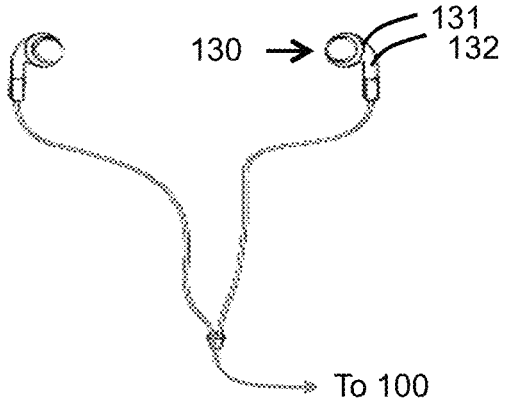
FIG. 1E illustrates a wearable headset comprising one or more earpieces for receiving or providing audio signals in accordance with an exemplary embodiment.

Referring to FIG. 1E, a headset 135 for multiplexing audio signals for use with one or more earpieces 130 as previously discussed is shown in accordance with one embodiment. In this embodiment, a dual earpiece (headset) in conjunction with the audio controller 100 operates as a wearable device for multiplexing audio signals from both the headset and the audio controller 100. Each earpiece 130 of the headset 135 includes a first microphone 131 for capturing a first microphone signal, a second microphone 132 for capturing a second microphone signal, and the audio controller 100 communicatively coupled to the first microphone 131 and the second microphone 132 to produce the composite signal (multiplexing of the microphone signals). Aspects of signal processing performed by the audio controller 100 may be performed by one or more processors residing in separate devices communicatively coupled to one another.

Figure 1F:
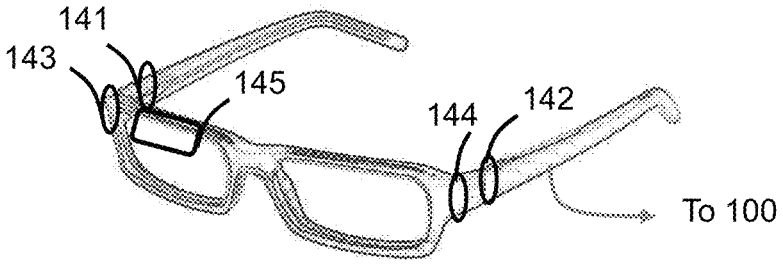
FIG. 1F illustrates wearable eyeglasses comprising one or more sensors for receiving or providing audio signals in accordance with an exemplary embodiment.

Referring to FIG. 1F, the eyeglasses 140 are shown in accordance with another wearable computing device as previously discussed. In this embodiment, eyeglasses 140 operate as the wearable computing device, for collective processing of multiple acoustic signals (e.g., ambient, environmental, voice, etc.) and media (e.g., accessory earpiece connected to eyeglasses for listening) when communicatively coupled to a media device (e.g., mobile device, cell phone, etc.). In this arrangement, analogous to an earpiece with microphones but rather embedded in eyeglasses, the user may rely on the eyeglasses for voice communication and external sound capture instead of requiring the user to hold the media device in a typical hand-held phone orientation (i.e., cell phone microphone to mouth area, and speaker output to the ears). That is, the eyeglasses sense and pick up the user's voice (and other external sounds) for permitting voice processing. The earpiece 130 may also be attached to the eyeglasses 140 for providing audio and voice, and voice control, as illustrated in the system 120 of FIG. 1B.

In the configuration shown, the first 141 and second 142 microphones are mechanically mounted to one side of eyeglasses to provide audio signal streams. Again, the embodiment 140 can be configured for individual sides (left or right) or include an additional pair of microphones on a second side in addition to the first side. The eyeglasses 140 can also include one or more optical elements, for example, cameras 143 and 144 situated at the front or other direction for taking pictures. Similarly, the audio controller 100 is communicatively coupled to the first microphone 141 and the second microphone 142 to produce the composite signal. As disclosed in U.S. patent application Ser. No. 13/108,883 entitled "Method and System for Directional Enhancement of Microphone Signals using Small Microphone Arrays", by the same authors, the entire contents of which are hereby incorporated by reference, the audio signals from the first microphone 141 and second microphone 142 are multiplexed and for analysis of a phase angle of the inter-microphone coherence for directional sensitivity, and which allows for directional sound processing and localization. In some embodiments, the embodiment 140 can further include a display 145.

Figure 1G:
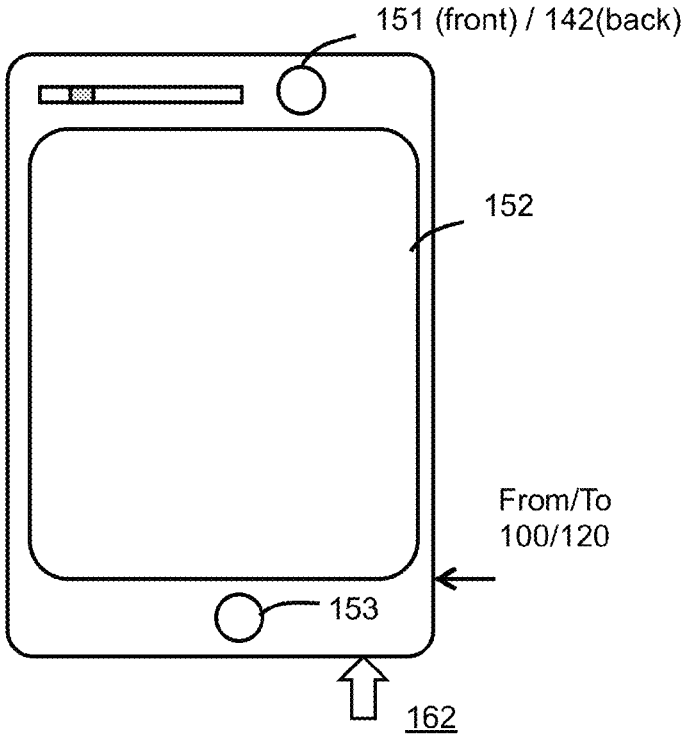
FIG. 1G illustrates a mobile device for coupling with a wearable system in accordance with an exemplary embodiment.
Figure 1H:
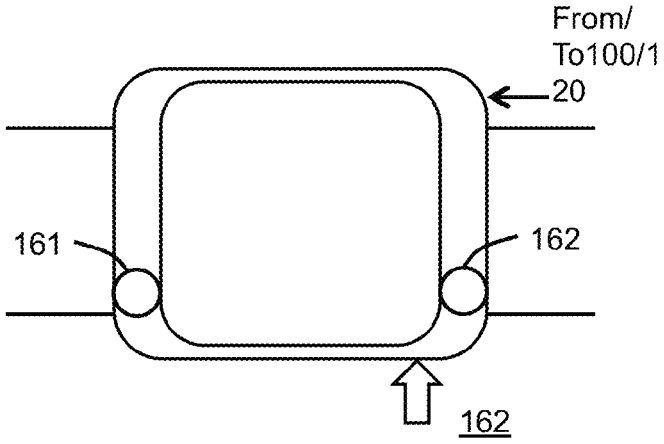
FIG. 1H illustrates a wristwatch for coupling with a wearable system or mobile device in accordance with an exemplary embodiment.

FIG. 1G depicts the mobile device 150 as a media device (i.e., smartphone) which can be communicatively coupled to the audio controller 100 and either or both of the wearable computing devices (130/140). It includes the single audio input jack 162 previously described for receiving audio input. The mobile device 150 can include one or more microphones 151/142 on a front and/or back side, a visual display 152 for providing user input, and an interaction element 153. FIG. 1H depicts a second media device 160 as a wristwatch device which also can be communicatively coupled to the one or more wearable computing devices (130/140). The device 160 can also include one or more microphones 161/162 singly or in an array, for example, beamforming for localization a user's voice or for permitting manual capture of a sound source when the wrist watch is manually oriented in a specific direction. It also includes the single audio input jack 162 previously described for receiving audio input.

As previously noted in the description of these previous figures, the processor performing the multiplexing of the audio signals can be included thereon, for example, within a digital signal processor or other software programmable device within, or coupled to, the media device 150 or 160. As will be discussed ahead, components of the media device for implementing multiplexing and de-multiplexing of separate audio signal streams to produce a composite signal will be explained in further detail.

With respect to the previous figures, the system 120 may represent a single device or a family of devices configured, for example, in a master-slave or master-master arrangement. Thus, components of the system 120 may be distributed among one or more devices, such as, but not limited to, the media device illustrated in FIG. 1G and the wristwatch in FIG. 1H. That is, the components of the system 120 may be distributed among several devices (such as a smartphone, a smartwatch, an optical head-mounted display, an earpiece, etc.). Furthermore, the devices (for example, those illustrated in FIG. 1E and FIG. 1F) may be coupled together via any suitable connection, for example, to the media device in FIG. 1G and/or the wristwatch in FIG. 1H, such as, without being limited to, a wired connection, a wireless connection or an optical connection.

It should also be noted that the computing devices shown can include any device having audio processing capability for collecting, mining and processing audio signals, or signals within the audio bandwidth (10 Hz to 20 KHz). Computing devices may provide specific functions, such as heart rate monitoring (low-frequency; 10-100 Hz) or pedometer capability (<20 Hz), to name a few. More advanced computing devices may provide multiple and/or more advanced audio processing functions, for instance, to continuously convey heart signals (low-frequency sounds) or other continuous biometric data (sensor signals). As an example, advanced "smart" functions and features similar to those provided on smartphones, smartwatches, optical head-mounted displays or helmet-mounted displays can be included therein. Example functions of computing devices providing audio content may include, without being limited to, capturing images and/or video, displaying images and/or video, presenting audio signals, presenting text messages and/or emails, identifying voice commands from a user, browsing the web, etc. Aspects of voice control included herein are disclosed in U.S. patent application Ser. No. 13/134,222 filed on Dec. 19, 2013 entitled "Method and Device for Voice Operated Control", with a common author, the entire contents, and priority reference parent applications, of which are hereby incorporated by reference in entirety.

Figure 2:
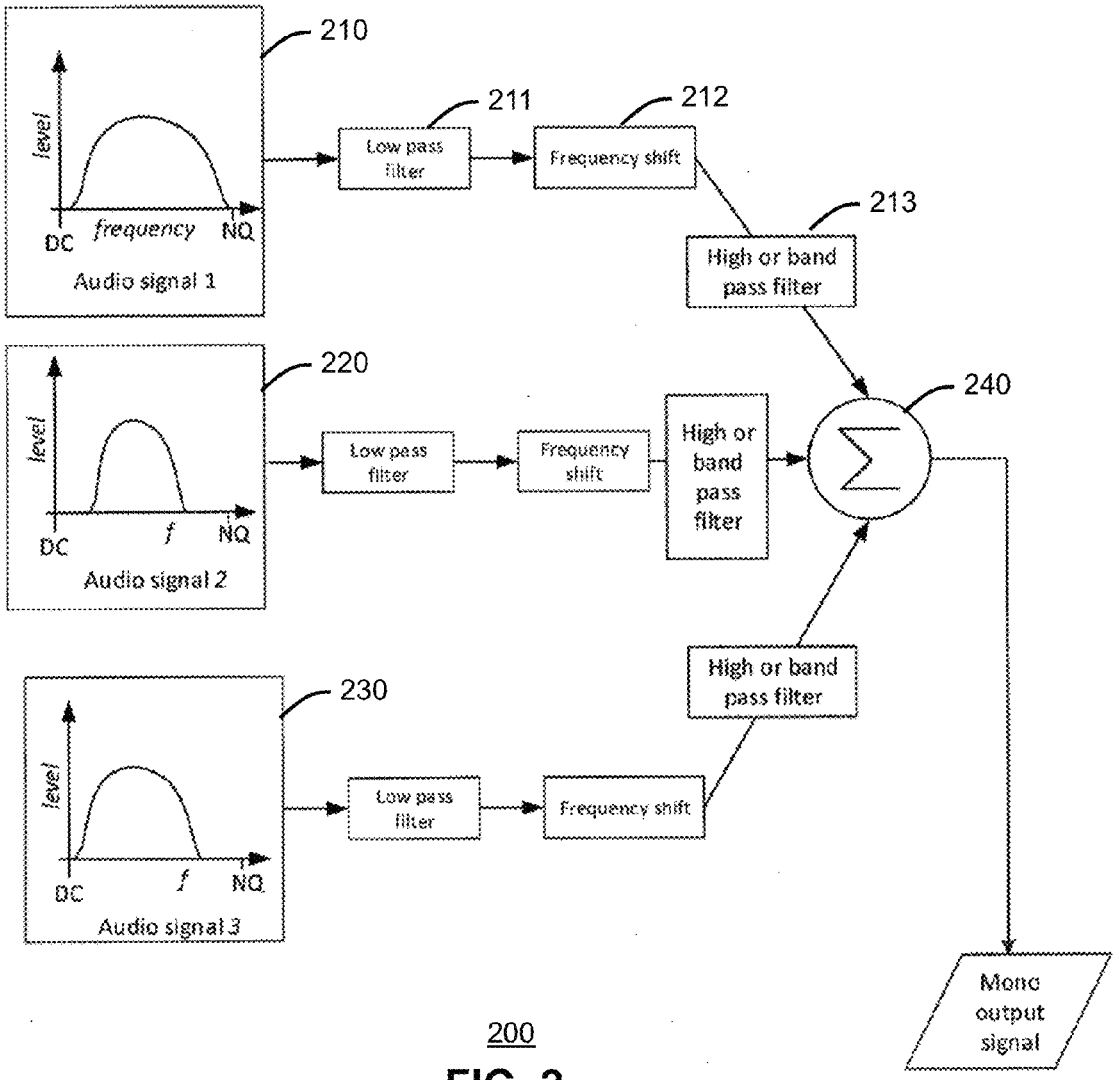
FIG. 2 depicts a block diagram of a method for frequency division multiplexing of audio signals to generate a single composite output signal in accordance with an exemplary embodiment.

FIG. 2 depicts a block diagram of a method 200 for frequency division multiplexing of audio signals to generate a single composite output signal in accordance with an exemplary embodiment. The method 200 may be practiced with more or less than the number of steps shown. When describing the method 200, reference will be made to certain figures for identifying exemplary components that can implement the method steps herein. Moreover, the method 200 can be practiced by the components presented in the figures herein though is not limited to the components shown.

The method 200 is described in the context of multiplexing audio signals provided from multiple microphones on a wearable device (e.g, audio controller 100, earpiece 130, headphones 135, eyeglasses 140, and/or wristwatch 160); namely, the earpiece 130 in this embodiment. The received audio input signals (e.g., 210, 220 and 230) can be generated by one or a combination of the following audio signals:

- An ambient sound microphone on an earphone;
- An ear canal microphone on an earphone;
- An ear canal receiver signal directed to a receiver (i.e., loudspeaker) on an earphone.
- A received audio content signal, where the audio content signal is directed from a portable mobile media device to an earphone (e.g. a music or voice signal).
- At least one microphone located on a control box, where the control box provides a user interface for controlling an earphone device.
- At least one microphone located on an "eye wear" frame, similar to a frame associated with a pair of glasses, e.g., prescription glasses or sunglasses.
- At least one microphone not located on a body.
- An audio signal generated by an amplifier, for instance from a received wireless communication device such as a Bluetooth connection, wireless local area network (WLAN) connection, magnetic induction (MI) link.

As illustrated in FIG. 2, the method 200 receives separate audio signals, in this case, audio signals 210, 220 and 230. These audio signals are provided from the microphones of the wearable device. Each audio signal 210, 220 and 230 undergoes a similar processing path respectively as shown through the low-pass filter 211, a frequency shifter 212, a high or band-pass filter 213. Each audio signal along its respective path is then summed at element 240 to produce the mono output signal. The resulting mono audio signal is directed to the receiving device (e.g., mobile phone 150, wrist watch 160) by a wired or wireless audio connector transmitted a single audio channel. As previously described, the wired connection may be using a conventional 3.5 mm 3 conductor TRS or 4 conductor TRRS audio connector found on most mobile phone or mobile computing devices. A wireless connector may be a Bluetooth connection, wireless local area network (WLAN) connection, or magnetic induction (MI) link.

The method 200, for multiplexing audio signals into a single audio channel, comprises in some embodiments the steps of receiving a first audio signal over a first audio link, receiving a second audio signal over a second audio link, upward frequency shifting the first audio signal to a first bandwidth range to produce a first frequency shifted signal, upward frequency shifting the second audio signal to a second bandwidth range to produce a second frequency shifted signal, summing the first frequency shifted signal and the second frequency shifted signal to produce a composite signal, and providing the composite signal over a single audio channel. Using the earpiece 130 as example, it includes at least one ambient sound microphone (ASM) for receiving an ambient sound signal and generating at least one ASM signal (210), and an Ear Canal Microphone (ECM) for receiving an ear-canal signal measured in the user's ear-canal and generating an ECM signal (220), wherein the ASM and ECM are communicatively coupled to the processor for providing the first audio link. The third audio signal 230 can be from the microphone 101 on the audio controller 100. Again, this microphone provides spatial separation from the earpiece microphones above for improving noise suppression directivity, localization enhancement, and reflection of sound off the body when the device 100 is worn around the neck (like a pendant).

With respect to FIG. 2, considering for exemplary purposes only two audio signals, the first audio channel 210 may be frequency shifted up by approximately 150 Hz, and then low pass filtered, such that the resulting frequency bandwidth of this first shifted audio channel is from approximately 150 Hz to approximately half the Nyquist frequency of the DSP audio sampling system (where the Nyquist frequency is half the sample rate of the stored audio digital signal following conversion to a digital signal via analog to digital converters). With two input audio signals 210 and 220, the second audio channel 220 is frequency shifted up by a frequency interval of approximately half the Nyquist frequency. Before the first or second audio signal is frequency shifted, it is optionally low pass filtered with an audio low pass-filter with a cut-off of approximately half the Nyquist frequency.

Alternatively or as well as the low pass filtering 211, after the first audio signal is optionally frequency shifted 212, or even if it is not frequency shifted, it is processed with a low pass filter with a cut-off frequency equal to approximately half the Nyquist frequency. This limits the bandwidth of the frequency shifted or not frequency shifted first audio signal to between DC and half the Nyquist frequency. Alternatively or as well as the low pass filtering, after the SECOND audio signal 220 is frequency shifted, it is processed with a high pass filter 213 with a cut-off frequency equal to approximately half the Nyquist frequency. This limits the bandwidth of the frequency shifted second audio signal to between half the Nyquist frequency and the Nyquist frequency. Where the resulting first frequency shifted signal is summed with a second received audio signal, the second received audio signal can be processed with a low pass filter such that the frequency bandwidth of the second received audio signal does not overlap with the bandwidth of the first frequency shifted signal The resulting modified two signals are then summed 240 to form a single mono signal, with the frequency spectrum of this mono signal divided into two parts: a first low frequency part for a representation of the first signal, and a second high frequency part for a representation of the second signal. In this exemplary two channel multiplexing embodiment, the frequency division of the two signals in the mono output signal is such that both signals have approximately equal bandwidth equal to half the Nyquist frequency: i.e., the ratio of the two bandwidths of the two multiplexed signals is approximately unity. However, in another embodiment of the present invention, the ratio of these two signals can be chosen to be less than or greater than zero by changing the value of the frequency shift and the cut-off frequency of the low pass or high-pass filters.

Although two channels are described in the multiplexing, there can be up to N channels and allocated in real-time as needed; for example, earphone 130 receives at least two audio signals from a single earphone (i.e., left or right earphone) or from two earphones (i.e., a left and right earphone pair). The two audio signals can be received by the DSP, one or both of these received audio signals is frequency shifted, summed, and directed to an audio output from the DSP on a single "mono" audio channel as illustrated. Exemplary permutations for two audio signals are:

- Left ambient sound microphone from left earphone and right ambient sound microphone from right earphone.
- Left ambient sound microphone from left earphone and ear canal microphone signal from left earphone.
- Right ambient sound microphone from right earphone and ear canal microphone signal from right earphone.
- Received Audio Content (AC) signal directed to left earphone and received Audio Content (AC) signal directed to right earphone.
- Signal directed to the left Ear Canal Receiver (ECR) and signal directed to the right Ear Canal Receiver (ECR).

Any number of audio signals can be multiplexed in accordance with the method 200 as described above. For example, with three audio signals 210, 220 and 230, the bandwidth ratio of the three multiplex signals may be unity (e.g. occupying a bandwidth on the mono audio channel of approximately the Nyquist frequency divided by the number of channels). Alternatively, the bandwidth of the audio channels on the mono output signal can be different. For instance, considering we wish to multiplex 3 channels with a DSP audio sample rate of 48 kHz, a Nyquist frequency of 24 kHz, the bandwidth of the first audio signal may be 10 kHz, and the bandwidth of the second and third multiplexed signal may be 5 kHz each. The number of channels and bandwidth of each channel can be set independently, e.g. using a user interface on a mobile device, and the desired bandwidth and number of audio channels communicated with the DSP via a wired or wireless data communication means, e.g. Bluetooth Low-Energy or WiFi.

The method 200 further includes determining a count of independently received audio signals, allocating independent frequency channels within a channel bandwidth according to the count, and, for each independent frequency channel, frequency shifting each of the independently received audio signals to an assigned independent frequency channel to produce a frequency shifted signal for each channel, and summing the frequency shifted signals in each channel to produce the composite signal. The count can be reassigned as the independently received audio signals are connected or disconnected; and the allocating of the independent frequency channels within a channel bandwidth can be adjusted according to the count. For instance, if the headphones 135 (of FIG. 1E) are originally multiplexed on the audio controller 100 to provide two way audio (ASM and ECM inputs, and ECR output) for each earpiece 130, and then a user pairs up the audio controller 100, the additional audio signals (microphones 141/142 on the eyeglasses) can be selectively multiplexed onto the current multiplexing scheme. As will be described ahead, the associated increase/decrease in the number of channels is managed to determine available bandwidth on each channel for applying spectral expansion. That is, the audio controller 100 keeps track of which types of signals are on an audio path, determines if they are candidates for spectral expansion based on type (e.g., microphone for voice), and allocates channel bandwidths with additional headroom for spectral expansion according to type.

With respect to the previous drawings and component descriptions the method 200 can be practiced, in one example, by way of the audio controller 100 shown in FIG. 1A. This audio controller for multiplexing audio signals into a single audio channel, includes at least one microphone 101 for receiving a first audio signal over a first audio link, at least one audio path 102 for receiving a second audio signal over a second audio link, a processor 103 communicatively coupled to the at least one microphone and the at least one audio path for upward frequency shifting the first audio signal to a first bandwidth range to produce a first frequency shifted signal, upward frequency shifting the second audio signal to a second bandwidth range to produce a second frequency shifted signal, summing the first frequency shifted signal and the second frequency shifted signal to produce a composite signal, and, a communication module 105 communicatively coupled to the processor for providing the composite signal over a single audio channel, and a power port 104 for receiving energy or hosting a battery to operate the processor and electronics of the audio controller for performing a multiplexing of audio signals to provide the composite signal over a single audio channel.

Figure 3A:
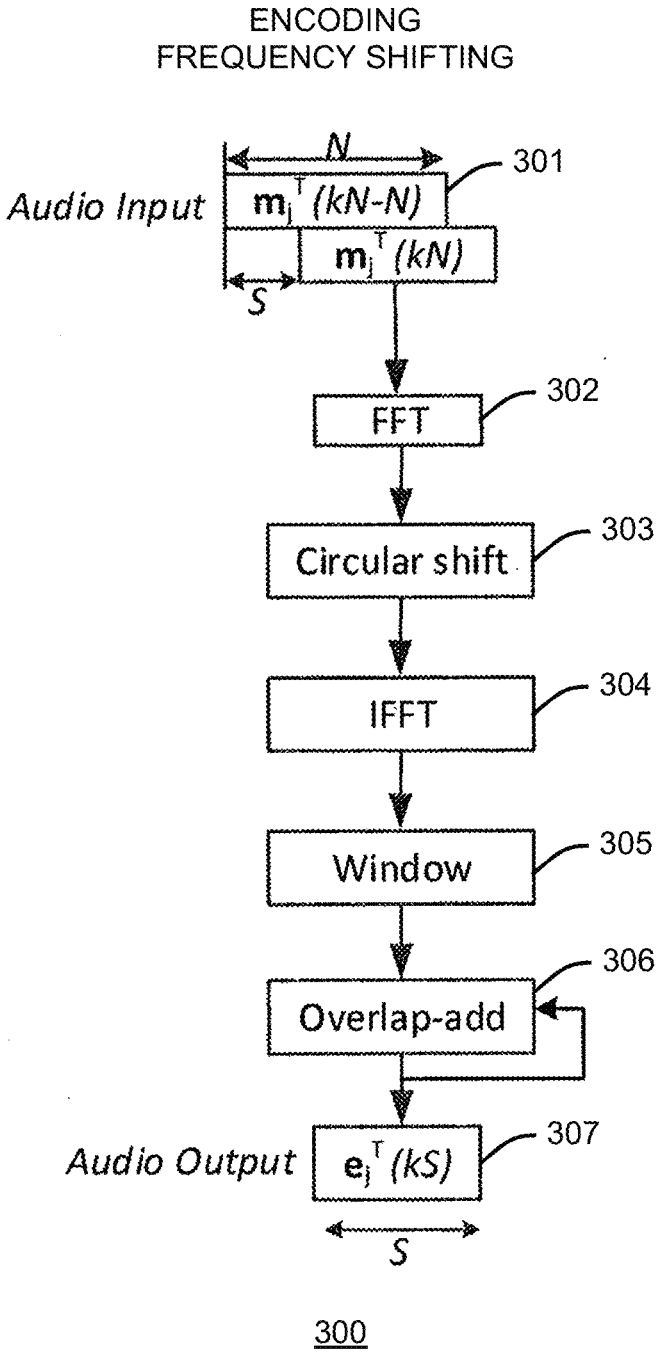
FIG. 3A depicts a block diagram of a method using an FFT shifting for encoding multiplexed audio signals in accordance with an exemplary embodiment.
Figure 4A:
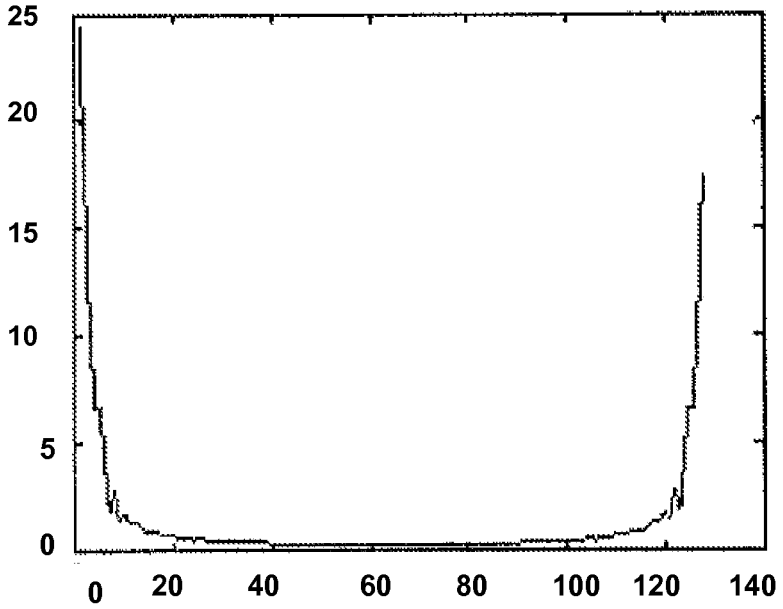
FIGS. 4A-4B illustrate frequency response graphs from application of the multiplexing methods herein in accordance with an exemplary embodiment.
Figure 4B:
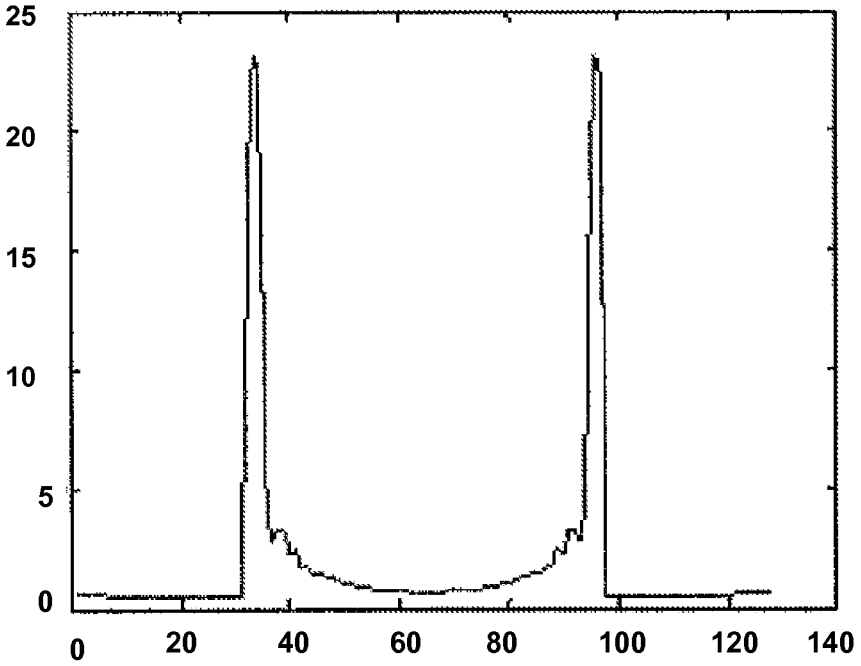

FIG. 3A depicts a block diagram of a method 300 using an FFT shifting for encoding multiplexed audio signals in accordance with an exemplary embodiment. The frequency shifting uses a frequency transform algorithm such as the FFT to provide frequency division multiplexing and does not require a carrier signal for the modulation. The method 300 may be practiced with more or less than the number of steps shown. When describing the method 300, reference may be made to certain figures for identifying, or naming, exemplary components that can implement the method steps herein. Moreover, the method 300 can be practiced by the components presented in the figures and named herein though is not limited to the components shown. Reference will also be made to FIGS. 4A-4B, which illustrates frequency response graphs from application of the multiplexing methods herein in accordance with an exemplary embodiment.

The method 300 can start in a state wherein an audio signal has been received. The audio signal is denoted by vector m. At step 301, a block of N samples is accumulated in a memory buffer. In a preferred embodiment, for a sample rate of 48 kHz, N is equal to 128 samples, and the overlap between successive input block (i.e., S in FIG. 3) is equal to 16. At step 302, the audio signal in the buffer is sampled and processed with a Fast Fourier Transform (FFT) algorithm. FIG. 4A shows an FFT spectral magnitude 410 for N-length input block after low pass filter stage (FFT tap versus magnitude). Depending on the implementation of the algorithm, and when N is even, the resulting FFT contains N/2+1 complex samples representing the frequency response from DC to the Nyquist frequency. Alternatively, with some FFT algorithms the results is 2*N complex samples with the second half of the FFT result containing samples that are a complex mirror of the first half of the FFT result (as is familiar to those skilled in the art).

At step 303, a circular shift is applied to the FFT result. Whether the FFT is represented as magnitude only with real terms of a coefficient set, or with phase angles using both real and imaginary terms of a coefficient set, the indexes of the coefficient set can also be rearranged to implement shifting, or the actual coefficients can be shifted in the buffer to implement the shifting. The FFT coefficients can be circularly shifted to produce a shifted FFT. Considering FFT algorithms of the first sort (i.e., resulting in N/2+1 complex samples), the frequency shift at step 303 can be efficiently implemented by a circular shift of the FFT samples. In a preferred embodiment, the frequency shift is by N/4 taps to the right (i.e. the $1^{st}$ DC tap is translated to the $N/4^{th}$ tap, and the second frequency tap is translated to the (N/4+1)th tap etc). FIG. 4B shows an FFT spectral magnitude 420 of FIG. 4A after frequency shifting.

At step 304, the frequency shifted, modified FFT is converted back to N time-domain samples using an IFFT. This time domain signal is then windowed at step 305, for example, using a Hanning window, although other windows are herein contemplated: Hamming, Butterworth, Blackman, Kaiser, etc. The resulting N windowed samples is then summed a step 306 with the previous output windowed samples according to an overlap-add technique. The resulting S new samples from the overlap-add at step 307 comprise the frequency shifted input signal. These new samples are then high-pass filtered so that they do not contain frequencies below approximately half the Nyquist frequency.

The frequency shifting for an audio signal is performed by applying a Fast Fourier Transform (FFT) to a block of audio samples in a bandwidth range for the audio signal; shifting the FFT to produce a shifted FFT, and applying an Inverse Fast Fourier Transform (IFFT) to the shifted FFT to produce a real-time domain signal, and wherein the summing of frequency shifted signals adds the real-time domain signal generated from each bandwidth range to produce the composite signal.

Figure 3B:
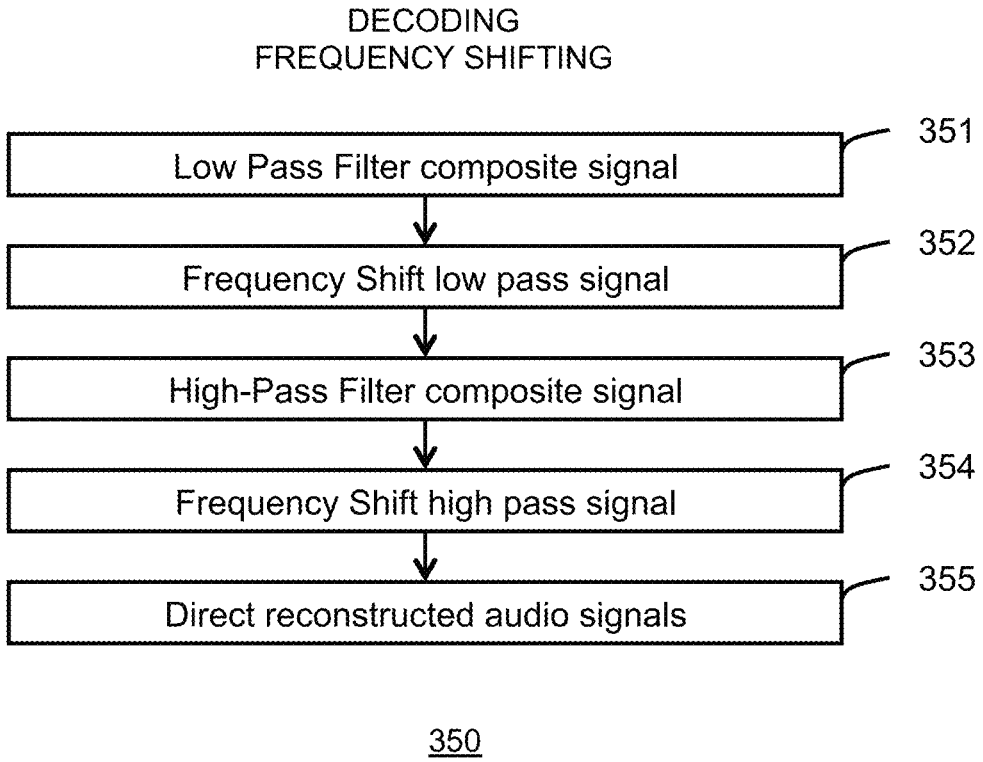
FIG. 3B depicts a block diagram of a method using an FFT shifting for decoding multiplexed audio signals in accordance with an exemplary embodiment.

FIG. 3B depicts a block diagram of a method 350 using an FFT shifting for decoding multiplexed audio signals in accordance with an exemplary embodiment. The method 350 may be practiced with more or less than the number of steps shown. When describing the method 350, reference may be made to certain figures for identifying, or naming, exemplary components that can implement the method steps herein. Moreover, the method 350 can be practiced by the components presented in the figures and named herein though is not limited to the components shown.

The method 350 for decoding a multiplexed (composite) signal is the same as the method 300 of encoding, except in the encoding method the shift is positive (i.e., upward frequency shift) and for decoding the shift is a downward frequency shift. The frequency shifting of an audio input signal is similarly performed using an FFT, and not using a modulator or carrier signal. For this example, method 350 will similarly be described for decoding two audio signals multiplexed together constituting the composite signal, although it should be noted that multiple audio signals multiplexed thereon can be decoded in a similar manner. The method 350 can start in a state where a composite signal has been received, for example, via the TRRS plug 170 inserted in the audio jack 162 of audio switch 160 previously described. The composite signal is buffered by the processor 161, or electronic circuitry, into a memory storage for processing.

At step 351, low-pass filtering is performed on the single received mono audio channel containing the composite signal to generate a first new audio signal. Similar to encoding, the composite signal can be provided on a circular buffer for a block of N samples. This first new audio signal is then downward frequency shifted at step 352 in a direction opposite to the upward frequency shifting operation previously used for encoding. For example, if the audio signal during encoding was shifted up by N/2 FFT samples, then it will be shifted down N/2 samples during decoding. In parallel, or sequentially, a high-pass filter is applied to the composite signal in the single received mono audio channel at step 353 to produce a second new audio signal. This second new audio signal is then downward frequency shifted at step 354 in a direction opposite to the upward frequency shifting operation used for encoding as similarly described. Either or both of the downward frequency shifted audio signals can optionally be processed with a low-pass filter. At step 355, the individually separated first and second new audio signals can be directed to a second system. The second system can be one or a combination of the following:

- an audio signal processing system
- an audio data storage device, e.g. using RAM memory on a mobile computing device
- a stereo (left and right) earphone system, where the first new audio signals is directed to one earphone and the second new audio signals is directed to the other earphone
- an audio telecommunications system
- a voice control software system, where received voice commands initiate specific machine control actions, e.g. sending an email, selecting a music track name, reporting the clock time The method 350 for extracting at least one audio signal from the composite signal over the single audio channel, includes the steps of receiving the composite signal over the single audio channel, band filtering the composite signal for at least one independent audio channel to produce a filtered audio signal for that independent audio channel; downward frequency shifting the filtered audio signal in the independent audio channel in an opposite direction to the upward frequency shifting previously applied on that audio channel to produce a baseband signal for that independent audio channel; and band filtering the baseband signal to generate a reconstructed audio signal. The band filtering can be one of low-pass, band-pass, band-stop, or high-pass filtering. In one arrangement, a data packet indicating a count and bandwidth can be received in connection with the composite signal, and the independent audio channels are allocated according to the count and the bandwidth. A reconstructed audio signal is then generated in accordance with the extracting for each independent audio channel. The count can be reassigned as independently received audio signals are connected or disconnected; and the allocating of the independent audio channels within a channel bandwidth can be adjusted according to the count.

Figure 4C:
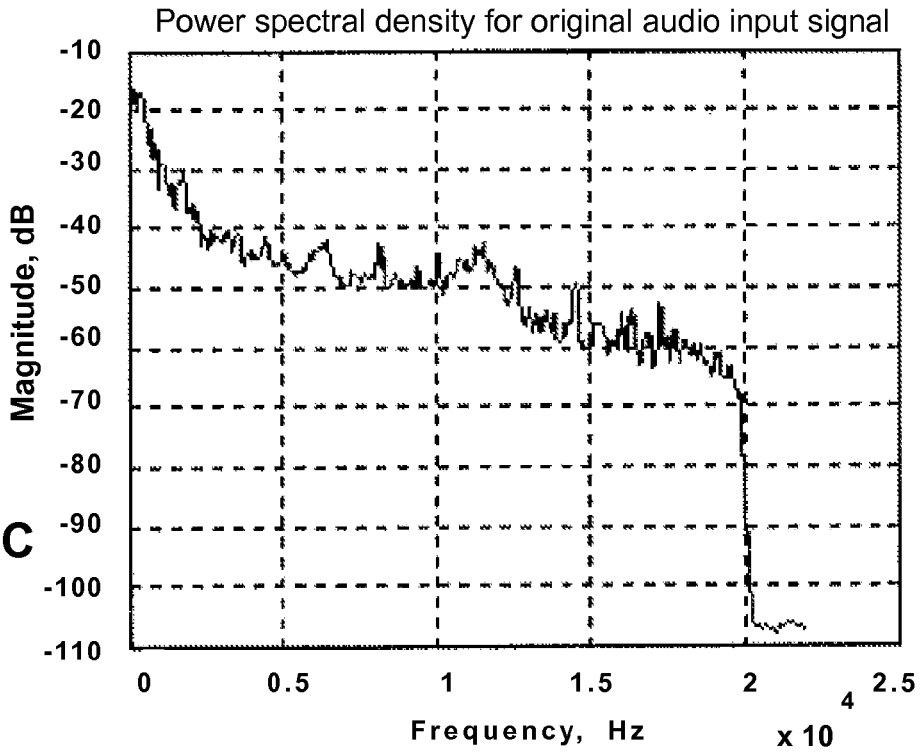
FIGS. 4C-4E illustrate power spectral density graphs from application of the multiplexing methods herein in accordance with an exemplary embodiment.
Figure 4D:
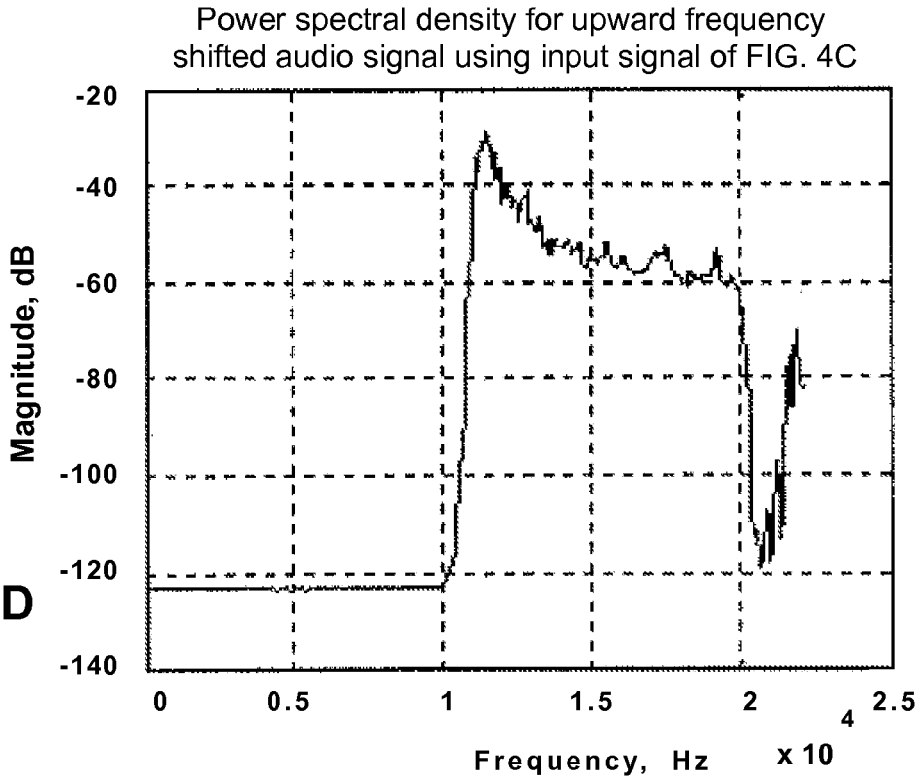
Figure 4E:
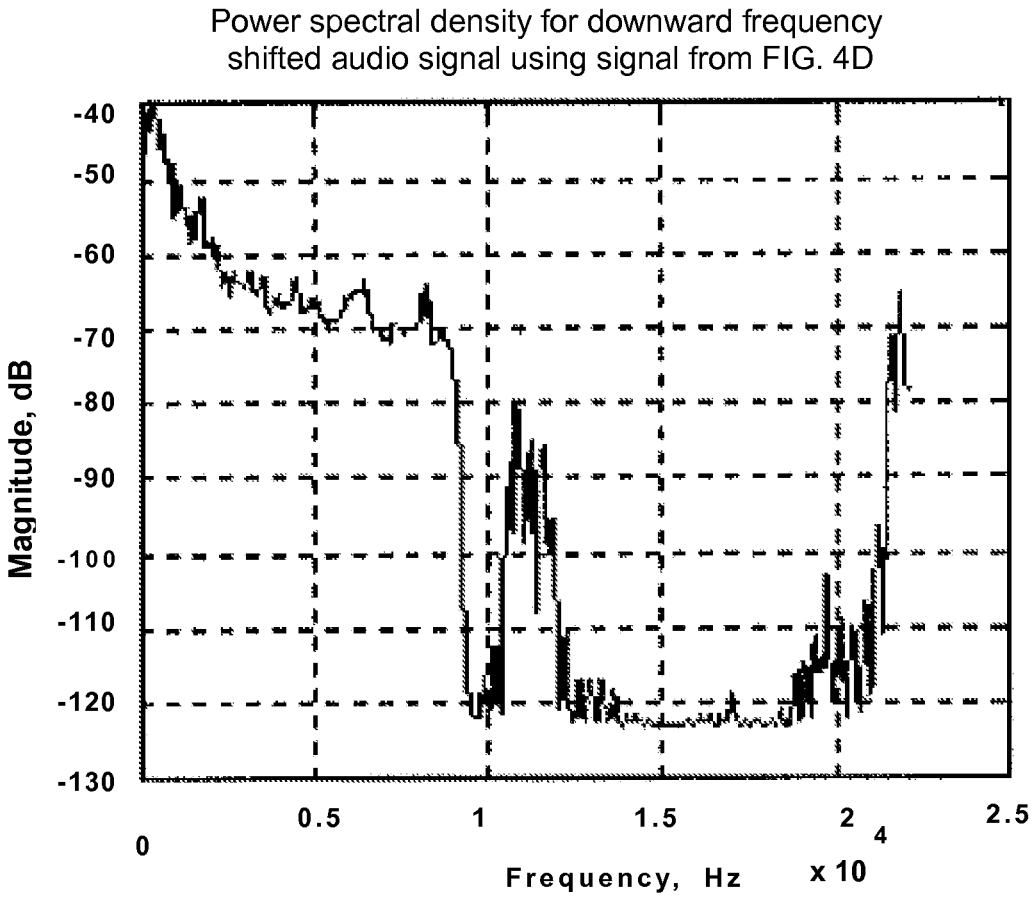

FIGS. 4C-4E illustrate spectra of audio input signals at different stages of the frequency shifting method; namely, power spectral density graphs from application of the multiplexing method 300 for encoding and method 350 for decoding. FIG. 4C shows the power spectral density 430 for an original audio input signal before low-pass filtering or any type of encoding or decoding. In this graph, the plot is for a one minute music signal. FIG. 4D shows the power spectral density 440 for upward frequency shifted audio signal using input signal in FIG. 4C in accordance with method 300 or encoding. FIG. 4E shows the power spectral density 450 for downward frequency shifted audio signal, using signal from FIG. 4D in accordance with method 350 or decoding. This is the spectrum before the optional last stage low-pass filter. In another configuration, the multiplexing and de-multiplexing audio system is used in conjunction with a spectral expansion system. Spectral expansion can be applied to the reconstructed audio signal to synthetically extend its audio spectrum to a substantially greater high frequency content than the received audio signal.

Figure 5:
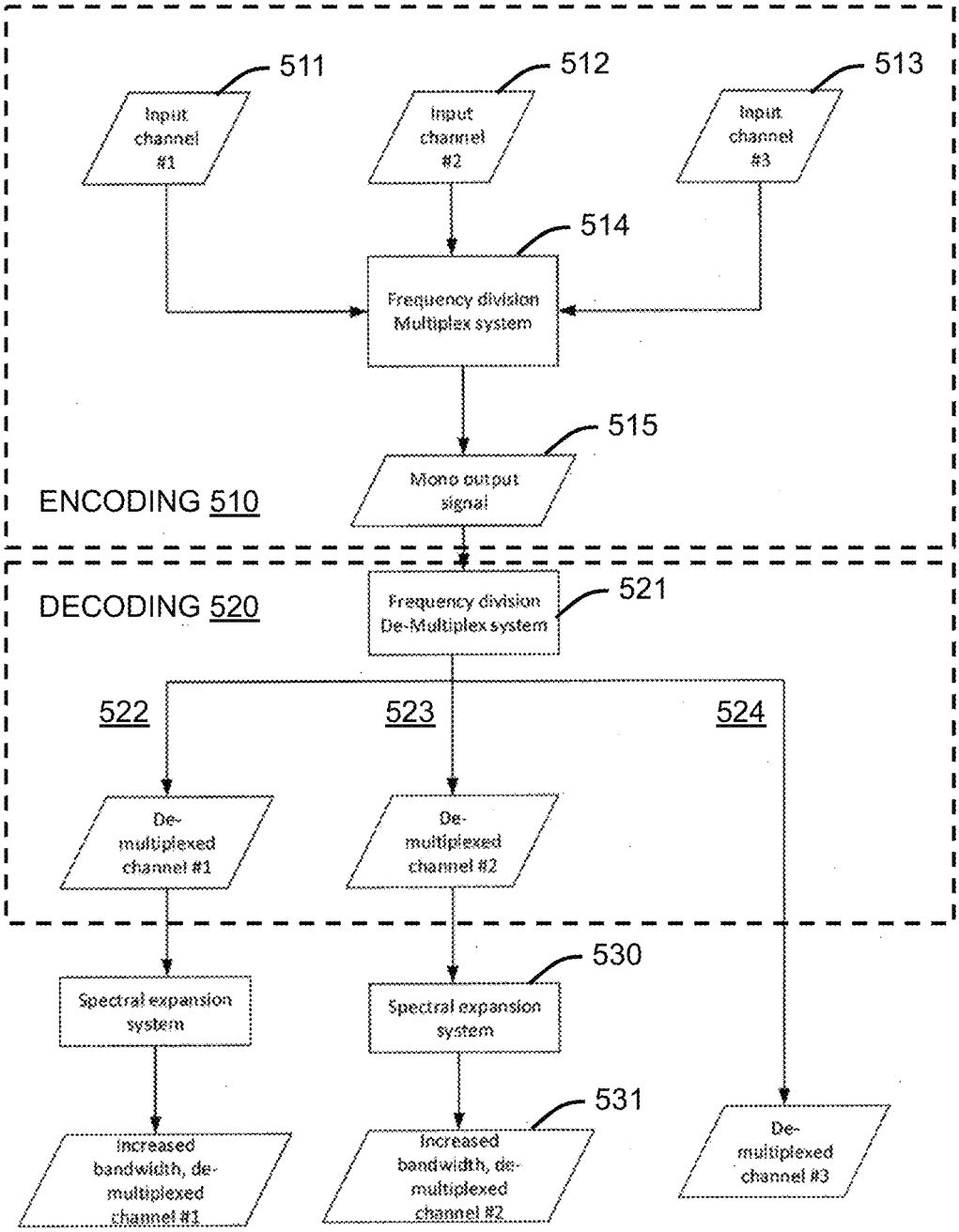
FIG. 5 depicts a block diagram of an audio multiplexing system for spectral expansion of audio signals in accordance with an exemplary embodiment.

FIG. 5 depicts a block diagram of an audio multiplexing system 500 for spectral expansion of audio signals in accordance with an exemplary embodiment. As illustrated, the audio multiplexing system 500 includes an encoding stage 510 and a decoding stage 520. The audio channels 511-513, frequency division multiplexing block 514 and mono-output signal block 515 of the encoding stage 510 are portions of the method 300 for encoding previously described. The decoding stage 520, including the frequency division de-multiplexing block 521 and generation of the (now separated) de-multiplexed audio signals 522-524 over respective audio output channels are portions of the method 350 for decoding previously described. The spectral expansion system is applied at step 530 after demultiplexing, and is used to increase the bandwidth of all or some of the de-multiplexed signal(s); namely, because the de-multiplexed signal will generally have a bandwidth smaller (and not greater) than the original input signal that was frequency-shifted and multiplexed with other audio signals. As such, the spectral expansion system is a process applied on at least one of the de-multiplexed output signals to provide a de-multiplexed signal with increased bandwidth (531).

As previously described, it should be noted that the spectral expansion bandwidth can be allocated based on the number of multiplexing channels assigned and with respect to an oversampled input signal. This can include up-sampling the audio signal prior to the FFT to increase a Nyquist frequency and corresponding frequency range for allocating channels. Just for numerical example purposes, for two audio signals each at a 20 KHz bandwidth, each can be oversampled at ×2+ to create an Fs=2*(20 KHz)=40 KHz before multiplexing. The first multiplexed signal can be frequency shifted to occupy the lower bandwidth 0-20 KHz, and the second multiplexed signal frequency shifted to occupy the upper bandwidth 20-40 KHz. On demultiplexing, each signal is restored to its original 20 KHz bandwidth. This was available because of resampling. If however, resampling is not an option, the two signals must share the bandwidth, and thus each signal when restored will only be half its bandwidth 0-10 KHz. Accordingly, spectral expansion can be applied to artificially extend or restore the missing frequency content.

In one arrangement the envelope of the original signal (before multiplexing) can be estimated prior to multiplexing, and communicated with the multiplexed signal as additional information, and then used to fill in the missing frequency content; for example, by noise shaping with the envelope. In another arrangement a mapping transform can learn envelope relationships between a wideband reference signal and a narrowband reference signal. As will be explained next, a mapping matrix can be generated from an envelope comparative analysis of a reference wideband signal and a reference narrowband signal that predicts high frequency energy from a low frequency energy envelope, which can be applied to the reconstructed audio signal to synthetically extend its audio spectrum. Aspects of spectral expansion included herein are disclosed in U.S. Provisional Patent Application 61/920,321 filed on Dec. 23, 2013 entitled "Method and Device for Spectral Expansion of an Audio Signal", by the same authors, the entire contents of which are hereby incorporated by reference.

Figure 6:
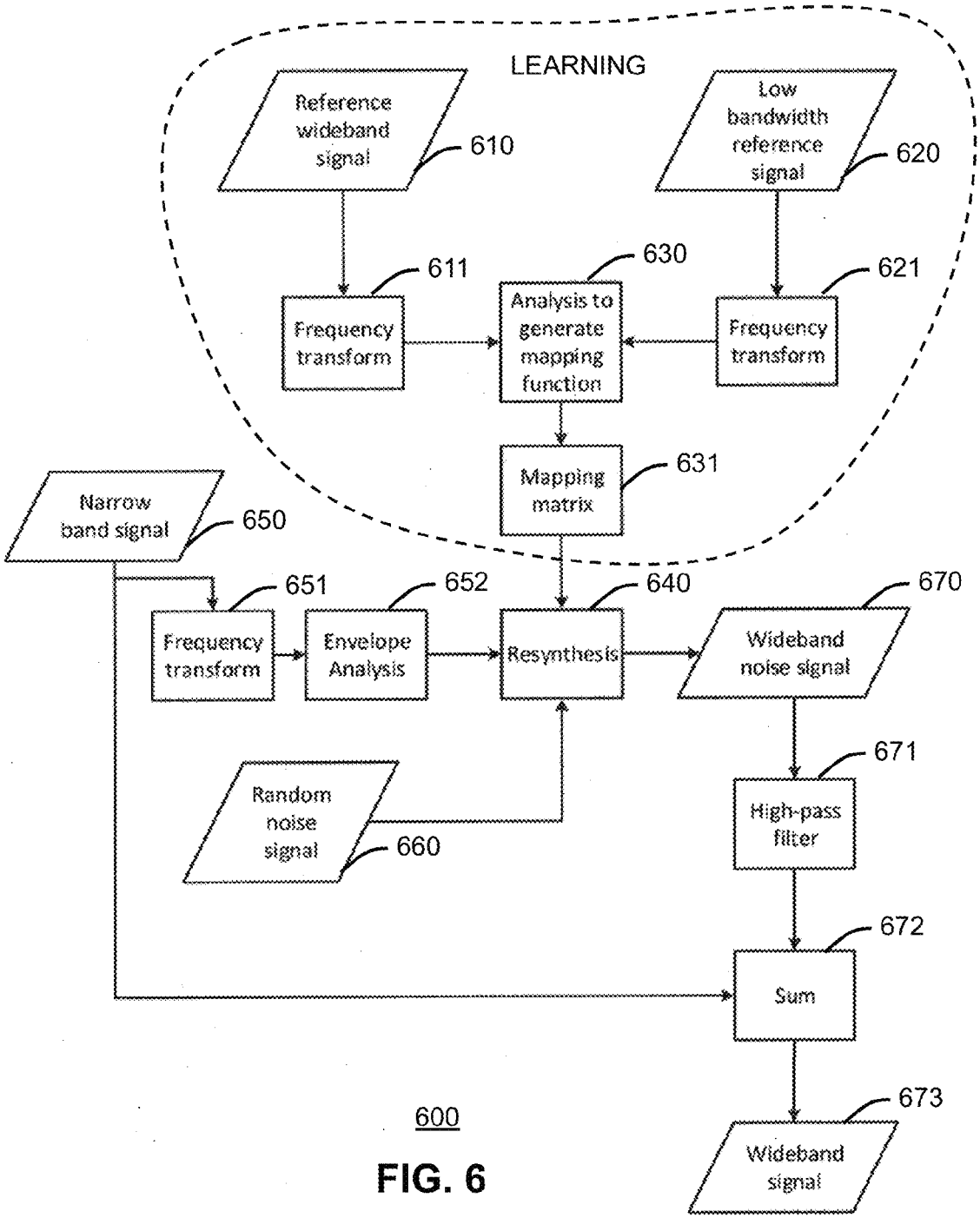
FIG. 6 depicts a block diagram of an audio multiplexing system using a mapping function for spectral expansion in accordance with an exemplary embodiment.

FIG. 6 depicts a block diagram of a method 600 for audio multiplexing using a mapping function for spectral expansion in accordance with an exemplary embodiment. Briefly, the blocks 610-631 are performed during a training phase (or learning phase) and can be performed before or independent of the other steps 640-673. The mapping function is based on learning and estimating signal characteristics between a reference wideband signal 610 and a low-bandwidth reference signal 620. The signal characteristics, can include, but is not limited to, envelope parameters (time domain and/or frequency domain), frequency content, signal shaping, energy distributions, signal ratios, frequency characteristics, and classification regions. A frequency transform 611 is applied to the reference wideband signal, and also a frequency transform 621 is applied to the low-bandwidth reference signal. An analysis is performed at block 630 to generate the mapping function; namely, extracting the signal characteristics for predicting and/or learning the transform relationship between the signals (in time and frequency domain). At block 631 the mapping matrix is generated. It one arrangement, it can be represented as a covariance matrix where each term of the matrix represents a variance of a parameter estimate; for example, an energy level, a spectral coefficient variance, etc. This mapping matrix 631 can be temporarily stored and retrieved during spectral expansion, which occurs after demultiplexing.

In the learning phase (blocks 610-631) the "mapping" (or "prediction") matrix is generated based on the analysis of the reference wideband signal 610 and the reference narrowband signal 620. The resulting mapping matrix 631 is a transformation matrix to predict high frequency energy from a low frequency energy envelope. In one exemplary configuration, the reference wideband and narrowband signals are made from a simultaneous recording of a phonetically balanced sentence made with an ambient microphone located in an earphone and an ear canal microphone located in an earphone of the same individual (i.e. to generate the wideband and narrowband reference signals, respectively). In another exemplary embodiment, the reference wideband signal is an audio signal before it is processed with the frequency multiplexer system (i.e. the low-pass filter, upward frequency shift, downward frequency shift and optional low-pass filter); and the reference narrowband signal is the same audio input signal that has been processed with the multiplexing system, i.e. following the de-multiplexing.

Once the mapping matrix has been generated, it can be applied to the de-multiplexed audio signals (e.g., audio signals in channels 522, 523 and 524 of FIG. 5) as will now be explained. Blocks 640-673 of FIG. 6 are directed to applying the mapping function 631 during resynthesis of a demultiplexed audio signal (which is the narrowband signal at block 650). A frequency transformation is applied to the narrowband signal at block 651 followed by an envelope analysis at block 652. The resulting envelope is spectrally extended in accordance with the mapping function at step 640 using random noise at block 660. More specifically, a resynthesized noise signal is generated by processing the random noise signal with the mapping matrix and the envelope. The resulting wideband noise signal at block 670 is then high-pass filtered at block 671 to produce a high-band noise signal, essentially artificially creating high-frequency content previously absent in the narrowband signal. This high-band noise signal is then summed with the narrow band signal at block 672 to produce the wideband signal at block 673.

Figure 7:
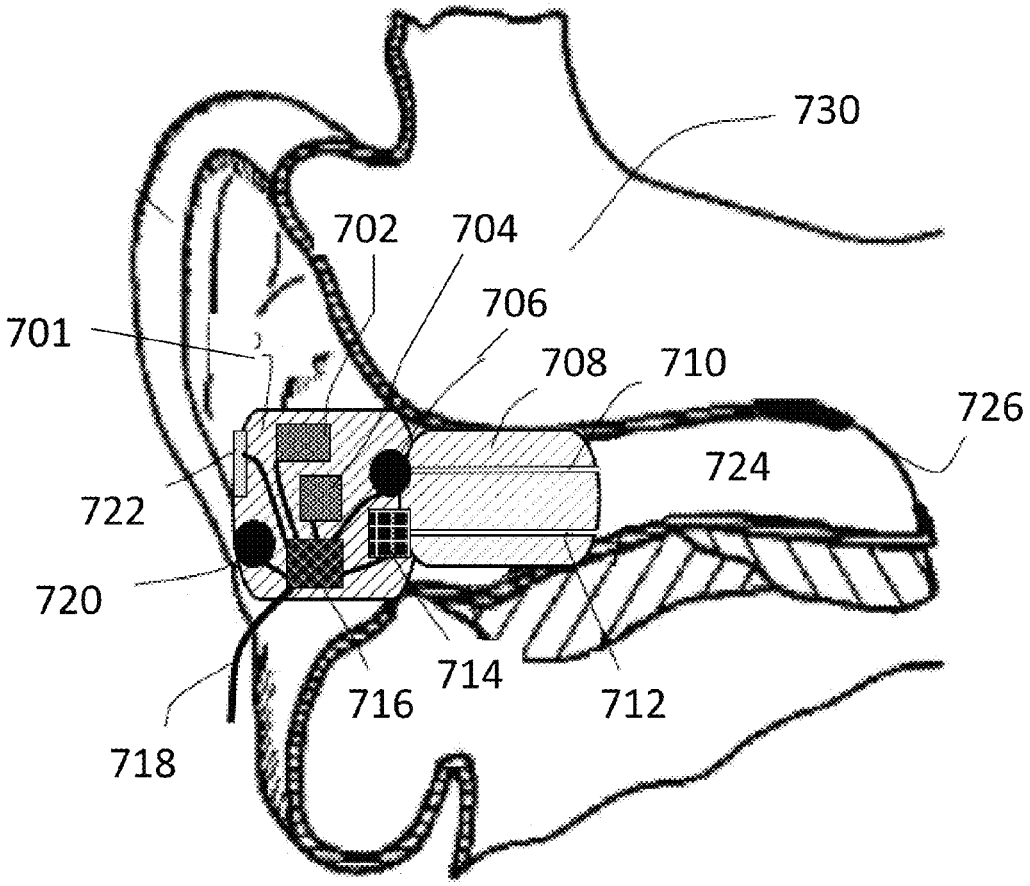
FIG. 7 is an exemplary earpiece for use with the coherence based directional enhancement system of FIG. 1A in accordance with an exemplary embodiment.

FIG. 7 is an illustration of an earpiece device 500 that can be connected to the system 100 of FIG. 1A for performing the inventive aspects herein disclosed. As will be explained ahead, the earpiece 700 contains numerous electronic components, many audio related, each with separate data lines conveying audio data. Briefly referring back to FIG. 1B, the system 100 can include a separate earpiece 700 for both the left and right ear. In such arrangement, there may be anywhere from 8 to 12 data lines, each containing audio, and other control information (e.g., power, ground, signaling, etc.)

As illustrated, the earpiece 700 comprises an electronic housing unit 701 and a sealing unit 708. The earpiece depicts an electro-acoustical assembly for an in-the-ear acoustic assembly, as it would typically be placed in an ear canal 724 of a user. The earpiece can be an in the ear earpiece, behind the ear earpiece, receiver in the ear, partial-fit device, or any other suitable earpiece type. The earpiece can partially or fully occlude ear canal 724, and is suitable for use with users having healthy or abnormal auditory functioning.

The earpiece, in some embodiments, includes an Ambient Sound Microphone (ASM) 720 to capture ambient sound, an Ear Canal Receiver (ECR) 714 to deliver audio to an ear canal 724, and an Ear Canal Microphone (ECM) 706 to capture and assess a sound exposure level within the ear canal 724. The earpiece can partially or fully occlude the ear canal 724 to provide various degrees of acoustic isolation. In at least one exemplary embodiment, assembly is designed to be inserted into the user's ear canal 724, and to form an acoustic seal with the walls of the ear canal 724 at a location between the entrance to the ear canal 724 and the tympanic membrane (or ear drum). In general, such a seal is typically achieved by means of a soft and compliant housing of sealing unit 708.

Sealing unit 708 is an acoustic barrier having a first side corresponding to ear canal 724 and a second side corresponding to the ambient environment. In at least one exemplary embodiment, sealing unit 708 includes an ear canal microphone tube 710 and an ear canal receiver tube 714. Sealing unit 708 creates a closed cavity of approximately 5 cc between the first side of sealing unit 708 and the tympanic membrane in ear canal 724. As a result of this sealing, the ECR (speaker) 714 is able to generate a full range bass response when reproducing sounds for the user. This seal also serves to significantly reduce the sound pressure level at the user's eardrum resulting from the sound field at the entrance to the ear canal 724. This seal is also a basis for a sound isolating performance of the electro-acoustic assembly.

In at least one exemplary embodiment and in broader context, the second side of sealing unit 708 corresponds to the earpiece, electronic housing unit 701, and ambient sound microphone 720 that is exposed to the ambient environment. Ambient sound microphone 720 receives ambient sound from the ambient environment around the user.

Electronic housing unit 701 houses system components such as a microprocessor 716, memory 704, battery 702, ECM 706, ASM 720, ECR, 714, and user interface 722. Microprocessor (or processor) 716 can be a logic circuit, a digital signal processor, controller, or the like for performing calculations and operations for the earpiece. Processor 716 is operatively coupled to memory 704, ECM 706, ASM 720, ECR 714, and user interface 722. A wire 718 provides an external connection to the earpiece. Battery 702 powers the circuits and transducers of the earpiece. Battery 702 can be a rechargeable or replaceable battery.

In at least one exemplary embodiment, electronic housing unit 701 is adjacent to sealing unit 708. Openings in electronic housing unit 701 receive ECM tube 710 and ECR tube 712 to respectively couple to ECM 706 and ECR 714. ECR tube 712 and ECM tube 710 acoustically couple signals to and from ear canal 724. For example, ECR outputs an acoustic signal through ECR tube 712 and into ear canal 724 where it is received by the tympanic membrane of the user of the earpiece. Conversely, ECM 714 receives an acoustic signal present in ear canal 724 though ECM tube 710. All transducers shown can receive or transmit audio signals to a processor 716 that undertakes audio signal processing and provides a transceiver for audio via the wired (wire 718) or a wireless communication path.

Figure 8:
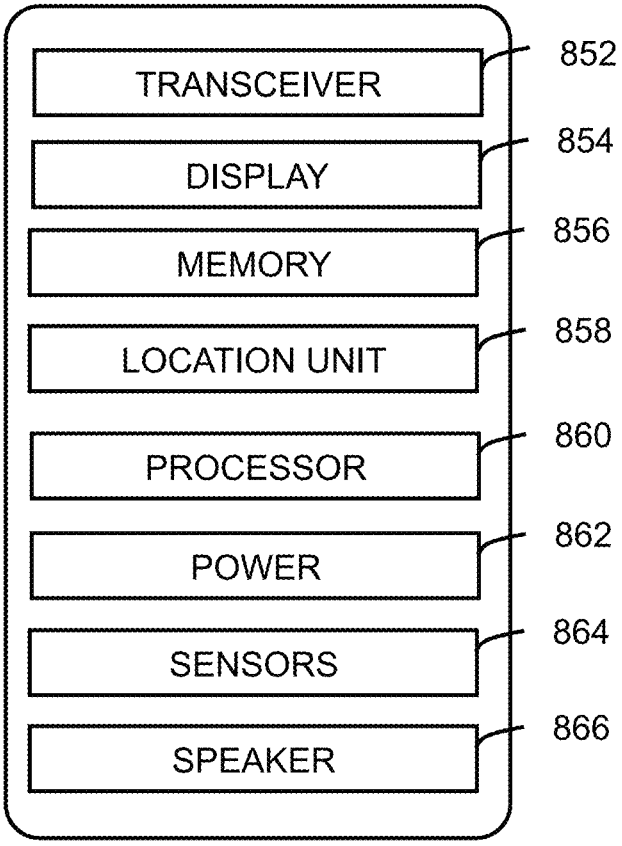
FIG. 8 is an exemplary mobile device for use with the coherence based directional enhancement system in accordance with an exemplary embodiment.

FIG. 8 depicts various components of a multimedia device 800 suitable for use for use with, and/or practicing the aspects of the inventive elements disclosed herein, for instance method 200 and method 300, though is not limited to only those methods or components shown. As illustrated, the device 800 comprises a wired and/or wireless transceiver 852, a user interface (UI) display 854, a memory 856, a location unit 858, and a processor 860 for managing operations thereof. The media device 800 can be any intelligent processing platform with Digital signal processing capabilities, application processor, data storage, display, input modality like touch-screen or keypad, microphones, speaker 866, Bluetooth, and connection to the internet via WAN, Wi-Fi, Ethernet or USB. The device 800 can further include other output modalities like speaker 866. This embodies custom hardware devices, Smartphone, cell phone, mobile device, iPad and iPod like devices, a laptop, a notebook, a tablet, or any other type of portable and mobile communication device. Other devices or systems such as a desktop, automobile electronic dash board, computational monitor, or communications control equipment is also herein contemplated for implementing the methods herein described. A power supply 862 provides energy for electronic components.

In one embodiment where the media device 800 operates in a landline environment, the transceiver 852 can utilize common wire-line access technology to support POTS or VoIP services. In a wireless communications setting, the transceiver 852 can utilize common technologies to support singly or in combination any number of wireless access technologies including without limitation Bluetooth™' Wireless Fidelity (WiFi), Worldwide Interoperability for Microwave Access (WiMAX), Ultra Wide Band (UWB), software defined radio (SDR), and cellular access technologies such as CDMA-1×, W-CDMA/HSDPA, GSM/GPRS, EDGE, TDMA/EDGE, and EVDO. SDR can be utilized for accessing a public or private communication spectrum according to any number of communication protocols that can be dynamically downloaded over-the-air to the communication device. It should be noted also that next generation wireless access technologies can be applied to the present disclosure.

The power supply 862 can utilize common power management technologies such as power from USB, replaceable batteries, supply regulation technologies, and charging system technologies for supplying energy to the components of the communication device and to facilitate portable applications. In stationary applications, the power supply 862 can be modified so as to extract energy from a common wall outlet and thereby supply DC power to the components of the communication device 800.

The location unit 858 can utilize common technology such as a GPS (Global Positioning System) receiver that can intercept satellite signals and there from determine a location fix of the portable device 800. The controller processor 860 can utilize computing technologies such as a microprocessor and/or digital signal processor (DSP) with associated storage memory such a Flash, ROM, RAM, SRAM, DRAM or other like technologies for controlling operations of the aforementioned components of the communication device.

This disclosure is intended to cover any and all adaptations or variations of various embodiments. In some embodiments, a method for multiplexing audio signals into a single audio channel can include the steps of receiving a first audio signal over a first audio link, receiving a second audio signal over a second audio link, upward frequency shifting at least one of the first audio signal to a first bandwidth range and the second audio signal to a second bandwidth range to respectively produce at least one of a first frequency shifted signal and a second frequency shifted signal or a non-frequency shifted signal. Note, the first frequency shifted signal, the second frequency shifted signal, and the non-frequency shifted signal are produced using a non-modulated signal. The method can further include summing at least one of the first frequency shifted signal or the second frequency shifted signal with one (of a remainder) of the first frequency shifted signal, the second frequency shifted signal or the non frequency shifted signal to produce a composite signal and providing the composite signal over a single audio channel. Thus, one of the first audio signal or second signal or both audio signals are frequency shifted. Summing can involve the summing of one or more frequency shifted audio signals. In one example, the summing involves summing of one frequency shifted audio signal and one non-frequency shifted signal. In another example, the summing involves the summing of two frequency shifted audio signals. The summing produces the composite signal. Combinations of the above embodiments, and other embodiments not specifically described herein, will be apparent to those of skill in the art upon reviewing the above description.

For example, U.S. Patent Application US 2012/0321097 by Keith Braho describes a headset signal multiplexing system and method that uses a first audio signal and a carrier signal to frequency shift the audio signal, and sum with a second non frequency shifted audio signal. This method necessarily requires the modulator signal to modulate the first audio signal, and this modulator is generated on a mobile device and received to an external signal processing system via a wired audio connection. This method described in application US 2012/0321097 has disadvantages that are overcome by the present invention. Such disadvantages are noted below.

First, the modulator must be generated by the external device, e.g., mobile phone. Such a modulation signal would consume power on the mobile phone. Second, to direct the modulation signal from a mobile phone to an earphone device during a phone-call may not be possible as the mobile phone would have to output the modulation signal on the wired connector with the mono audio connector, e.g., TRRS, or TRS, connector and mix this signal with the received phone audio signal from the remote party, which some mobile phone operating system do not allow (i.e., if a phone call is present, the phone Operating System does not allow other applications running on the phone to also output an audio signal on the TRRS output).

A third disadvantage of the modulation method of Application US 2012/0321097 is that only one of the two audio signals is frequency shifted. This non frequency-shifted signal is directed into the TRRS (or TRS) connector and processed by an analog-to-digital converter (ADC), and then further processed by a software application on the mobile device. However, for most mobile devices the frequency response of the received digital signal (i.e., after the ADC) is high-pass filter, e.g. using a $1^{st}$ order high pass filter with a cut-off frequency at between 100 Hz and 200 Hz. As such, the processed audio signal will have low frequency components attenuated, with a reduced low frequency signal-to-noise ratio. An embodiment of the present invention overcomes this limitation by upwardly frequency shifting this low-frequency audio signal by approximately 200 Hz, so that it can be demodulated and the low frequency audio recovered with a high signal-to-noise ratio.

A fourth advantage of the present frequency shifting method of the present invention is that the frequency shifting is undertaken in the frequency domain, e.g. using the Fast Fourier Transform. This is advantageous as other signal processing is often undertaken on the earphone microphone signals in the frequency domain, e.g., noise reduction or beamforming (directional enhancement) algorithms.

These are but a few examples of embodiments and modifications that can be applied to the present disclosure without departing from the scope of the claims stated below. Accordingly, the reader is directed to the claims section for a fuller understanding of the breadth and scope of the present disclosure.

What is claimed is:

1. A method for multiplexing audio signals into a single audio channel, the method comprising the steps of:

receiving a first audio signal over a first audio link;

receiving a second audio signal over a second audio link;

upward frequency shifting at least one of the first audio signal to a first bandwidth range and the second audio signal to a second bandwidth range to respectively produce at least one of a first frequency shifted signal and a second frequency shifted signal or a non-frequency shifted signal, the first frequency shifted signal, the second frequency shifted signal, and the non-frequency shifted signal are produced using a non-modulated signal;

summing at least one of the first frequency shifted signal or the second frequency shifted signal with one of a remainder of the first frequency shifted signal, the second frequency shifted signal or the non frequency shifted signal to produce a composite signal;

providing the composite signal over a single audio channel; and extracting at least one audio signal from the composite signal over the single audio channel by:

receiving the composite signal over the single audio channel;

band filtering the composite signal for at least one independent audio channel to produce a filtered audio signal for the at least one independent audio channel;

downward frequency shifting the filtered audio signal in the at least one independent audio channel in an opposite direction to the upward frequency shifting previously applied on that audio channel to produce a baseband signal for the at least one independent audio channel; and band filtering the baseband signal to generate a reconstructed audio signal.

2. The method of claim 1, further comprising determining a count of independently received audio signals;

allocating independent frequency channels within a channel bandwidth according to the count;

for each independent frequency channel, frequency shifting each of the independently received audio signals to an assigned independent frequency channel to produce a frequency shifted signal for each channel; and summing the frequency shifted signals in each channel to produce the composite signal.

3. The method of claim 2, further comprising reassigning the count as the independently received audio signals are connected or disconnected; and adjusting the allocating of the independent frequency channels within a channel bandwidth according to the count.

4. The method of claim 1, wherein the frequency shifting for an audio signal is performed by:

applying a Fast Fourier Transform (FFT) to a block of audio samples in a bandwidth range for the audio signal;

shifting the FFT to produce a shifted FFT; and applying an Inverse Fast Fourier Transform (IFFT) to the shifted FFT to produce a real-time domain signal, and wherein the summing of frequency shifted signals adds the real-time domain signal generated from each bandwidth range to produce the composite signal.

5. The method of claim 1, further comprising receiving in connection with the composite signal, a data packet indicating a count and bandwidth;

allocating the independent audio channels according to the count and the bandwidth; and performing the steps of said extracting for each independent audio channel to generate the reconstructed audio signal.

6. The method of claim 5, further comprising:

reassigning the count as independently received audio signals are connected or disconnected; and adjusting the allocating of the independent audio channels within a channel bandwidth according to the count.

7. The method of claim 1, wherein the band filtering is one of low-pass, band-pass, band-stop, or high-pass filtering.

8. The method of claim 4, further comprising applying a window to the block of audio samples prior to applying the FFT.

9. The method of claim 4, further comprising circularly shifting coefficients of the FFT to produce the shifted FFT.

10. The method of claim 4, further comprising up-sampling the audio signal prior to the FFT to increase a Nyquist frequency and corresponding frequency range for allocating channels.

11. The method of claim 4, wherein the step of providing the composite signal over a single audio channel is performed by communicating the composite signal over a wireless data channel, that is one of Bluetooth or Wi-Fi.

12. The method of claim 1, further comprising applying spectral expansion to the reconstructed audio signal to synthetically extend its audio spectrum to a substantially greater high frequency content than the received audio signal.

13. The method of claim 12, wherein the spectral expansion includes:

creating a mapping matrix from an envelope comparative analysis of a reference wideband signal and a reference narrowband signal that predicts high frequency energy from a low frequency energy envelope; and applying the mapping matrix to the reconstructed audio signal to synthetically extend its audio spectrum.

14. An audio controller for multiplexing audio signals into a single audio channel, comprising:

at least one microphone for receiving a first audio signal over a first audio link;

at least one audio path for receiving a second audio signal over a second audio link;

a processor communicatively coupled to the at least one microphone and the at least one audio path for:

upward frequency shifting at least one of the first audio signal to a first bandwidth range and the second audio signal to a second bandwidth range to respectively produce at least one of a first frequency shifted signal and a second frequency shifted signal or a non-frequency shifted signal, the first frequency shifted signal, the second frequency shifted signal, and the non-frequency shifted signal are produced using a non-modulated signal;

summing at least one of the first frequency shifted signal or the second frequency shifted signal with one of a remainder of the first frequency shifted signal, the second frequency shifted signal or the non frequency shifted signal to produce a composite signal;

a communication module communicatively coupled to the processor for providing the composite signal over a single audio channel;

a power port for receiving energy or hosting a battery to power the processor and electronics of the audio controller for performing a multiplexing of audio signals to provide the composite signal over a single audio channel; and the processor further configured for:

receiving the composite signal over the single audio channel;

band-filtering the composite signal for at least one independent audio channel to produce a filtered audio signal;

downward frequency shifting the filtered audio signal in the independent audio channel in an opposite direction to an upward frequency shifting previously applied on that audio channel to produce a baseband signal for that independent audio channel; and band-filtering the baseband signal to generate a reconstructed audio signal delivered to the ECR.

15. The audio controller of claim 14, further including an earpiece comprising:

at least one ambient sound microphone (ASM) for receiving an ambient sound signal and generating at least one ASM signal; and an Ear Canal Microphone (ECM) for receiving an ear-canal signal measured in the user's ear-canal and generating an ECM signal, wherein the ASM and ECM are communicatively coupled to the processor for providing the first audio link.

16. The audio controller of claim 15, further comprising:

an Ear Canal Receiver (ECR) for receiving an audio signal and generating a sound field in a user ear-canal, wherein the ECR is communicatively coupled to the processor for providing an output audio responsive to the processor, and wherein the reconstructed audio signal is delivered to the ECR.

17. The audio controller of claim 14, wherein the processor determines a count of independently received audio signals;

allocates independent frequency channels within a channel bandwidth according to the count;

for each independent frequency channel, frequency shifts each of the independently received audio signals to an assigned independent frequency channel to produce a frequency shifted signal for each channel; and sums the frequency shifted signals in each channel to produce the composite signal.

18. The audio controller of claim 14, wherein the processor reassigns the count as the independently received audio signals are connected or disconnected; and adjusts the allocating of the independent frequency channels within a channel bandwidth according to the count.

19. The audio controller of claim 14, wherein the processor applies a Fast Fourier Transform (FFT) to a block of audio samples in a bandwidth range for the audio signal;

shifts the FFT to produce a shifted FFT; and applies an Inverse Fast Fourier Transform (IFFT) to the shifted FFT to produce a real-time domain signal, and wherein the summing of frequency shifted signals adds the real-time domain signal generated from each bandwidth range to produce the composite signal.

* * * * *